United States Patent [19]

Mattei et al.

[11] Patent Number: 4,584,816

[45] Date of Patent: Apr. 29, 1986

[54] MACHINE FOR WRAPPING AND GROUPING PRODUCTS

[75] Inventors: Riccardo Mattei; Antonio Gamberini, both of Bologna, Italy

[73] Assignee: G.D. Societa per Azioni, Bologna, Italy

[21] Appl. No.: 672,338

[22] Filed: Nov. 16, 1984

[30] Foreign Application Priority Data

Dec. 7, 1983 [IT] Italy ..... 3649 A/83

[51] Int. Cl.[4] ..... B65B 35/30; B65B 11/28

[52] U.S. Cl. ..... 53/171; 53/176; 53/234; 53/531; 198/404; 198/408

[58] Field of Search ..... 53/171, 176, 234, 542, 53/544, 531; 198/404, 408

[56] References Cited

U.S. PATENT DOCUMENTS

| | | | |
|---|---|---|---|
| 1,217,923 | 3/1917 | Donnelly | 198/404 |
| 2,565,779 | 8/1951 | Muddiman | 198/404 |
| 4,020,608 | 5/1977 | Seragnoli | 53/234 |
| 4,265,073 | 5/1981 | Seragnoli | 53/234 X |
| 4,352,264 | 10/1982 | Seragnoli | 53/171 X |

FOREIGN PATENT DOCUMENTS

| | | | |
|---|---|---|---|
| 2715121 | 10/1978 | Fed. Rep. of Germany | 198/404 |

*Primary Examiner*—John Sipos

[57] ABSTRACT

The machine for wrapping and grouping products of parallelepiped and/or flat shape is of the type in which the individual products are conveyed by a wrapping wheel and wrapped in accordance with the so-called "pointed end" wrapping manner.

From said wheel the products pass to a conveying and overturning apparatus to be inverted before reaching a wheel for the formation and transfer of groups constituted by products disposed side-by-side edgewise with their contacting edges in a plane normal to the longitudinal dimension of said groups.

This overturning enables the groups to be introduced into the cells of a wrapping wheel with their pointed ends facing the bottom of said cells.

4 Claims, 3 Drawing Figures

MACHINE FOR WRAPPING AND GROUPING PRODUCTS

BACKGROUND OF THE INVENTION

This invention relates to an improved machine for wrapping and grouping products.

In particular, the invention relates to a machine for wrapping individual products of substantially parallelepiped and/or flat shape (sweets, tablets ect.), and then to collect said products into groups of a determined number of units, and to overwrap them.

The groups formed by a machine of the aforesaid type constitute those packages commonly known by the name of sticks.

In normal packages, the component products of the sticks are disposed side-by-side with their major faces in contact, or in other words are disposed in a mutally flat arrangement.

Recently, sticks have been introduced on to the market in which the products are disposed side-by-side edgewise with their contacting edges in a plane normal to the longitudinal dimension of the groups.

A wrapping machine of the present applicant able to produce sticks of the described type is known, comprising a first wrapping wheel provided for wrapping the individual products in accordance with the so-called "pointed end" wrapping manner.

This type of wrapping is obtained by enclosing each product in a tubular sheath, the ends of which are folded triangularly (the socalled "pointed ends") and are then folded down on to one of the two major faces of said products.

In the said machine, the individual wrapped products are the extracted from the wrapping wheel and inserted one next to the other into the compartments of a conveying wheel.

A group comprising a number of products equal to the number required for one stick is formed in this manner in each of said compartments. Said groups are extracted from the conveying wheel and, after placing a sheet of wrapping material between them, are inserted into the compartments of a second wrapping wheel, the purpose of which is to form the sticks. In the second wrapping wheel, each of the component products of one group has its pointed ends facing outwards from the compartments.

This arrangement give rise to certain drawbacks.

In this respect, the said pointed ends, because of the elasticity of the wrapping material, tend to separate from the faces on to which they were previously folded down, with the result that they hinder the folding operations carried out on the outer sheet in the second wrapping wheel. Furthermore, the longitudinal edges of the outer sheet are superposed on the group of products on top of said pointed ends, which prevent perfect adhesion of the outer wrapping to the products, and can thus cause these latter to lose their hermetic seal.

SUMMARY OF THE INVENTION

The object of the present invention is to provide an improved machine for forming sticks in which the products are disposed edgewise with their contacting edges in a plane normal to the longitudinal dimension of said sticks, in which the described drawbacks are absent.

Said object is attained according to the present invention by a machine for wrapping and grouping products, comprising a wheel for wrapping individual products, a wheel for forming and transferring groups constituted by products arranged side-by-side edgewise with their contacting edges in a plane normal to the longitudinal dimension of said groups, this latter wheel being disposed downstream of said wrapping wheel in the direction of advancement of the products, and a wheel for wrapping said groups, the improvement residing in that the machine further comprises a conveying and overturning apparatus for said products, which is situated between said wheel for wrapping the individual products and said wheel for forming and transferring said groups, said apparatus comprising a conveyor in the form of compartments which receives each of said products in a respective compartment, and, situated along the path of said conveyor, means for transferring each of said products from a first compartment to a second compartment and for overturning it during the course of said transfer. The novel features which are considered as characteristics of the invention are set forth in particular in the appended claims. The machine itself, however, both as to its construction and its mode of operation, together with additional features and advantages thereof, will be best understood upon perusal of the following detailed description of a preferred embodiment with reference to the accompanying drawings.

DESCRIPTION OF THE PREFERRED EMBODIMENT

Figure 1:
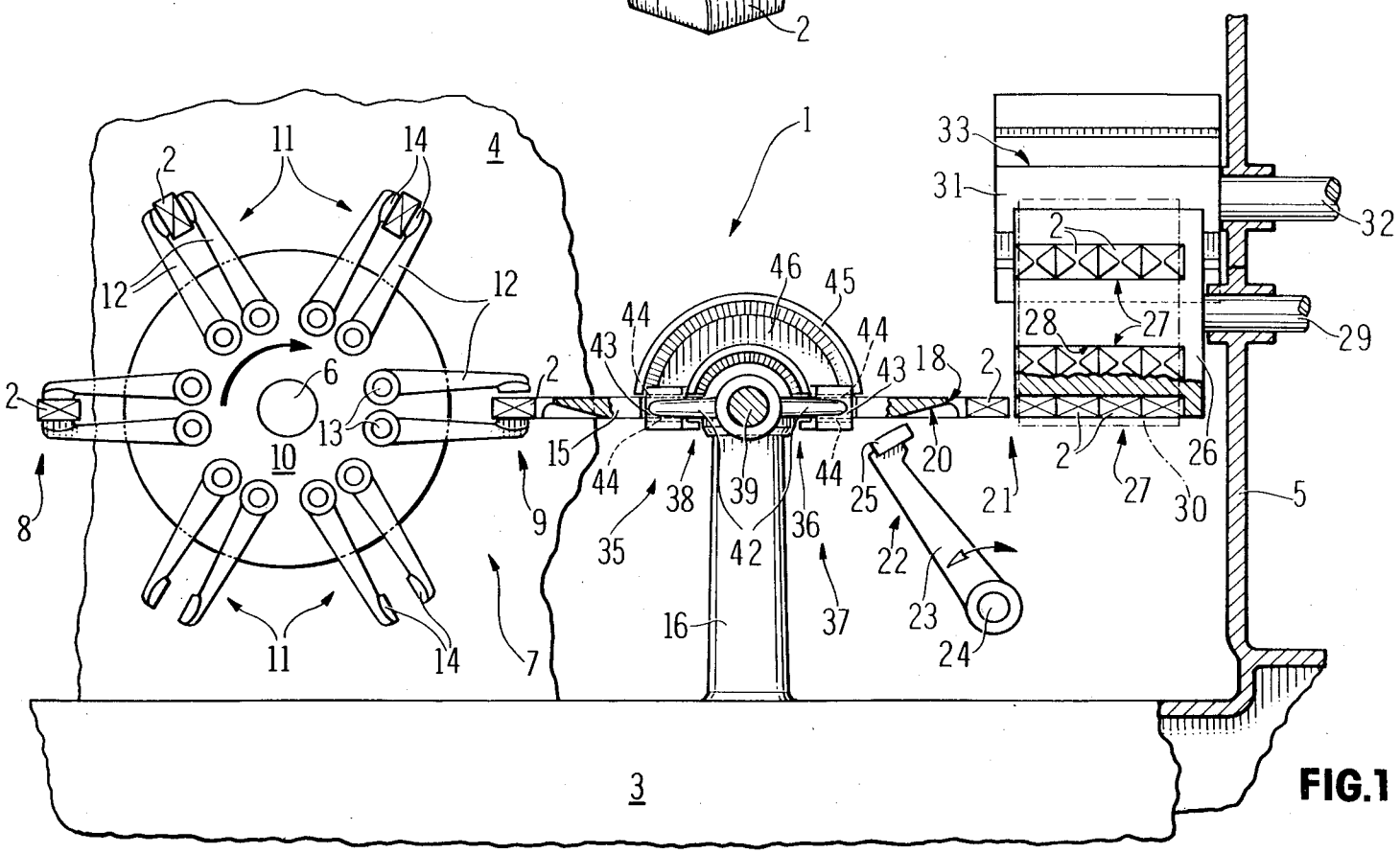
FIG. 1 is a front diagrammatic view, with certain parts shown in section or removed for greater clarity, of a machine for wrapping and grouping products constructed in accordance with the present invention.
Figure 2:
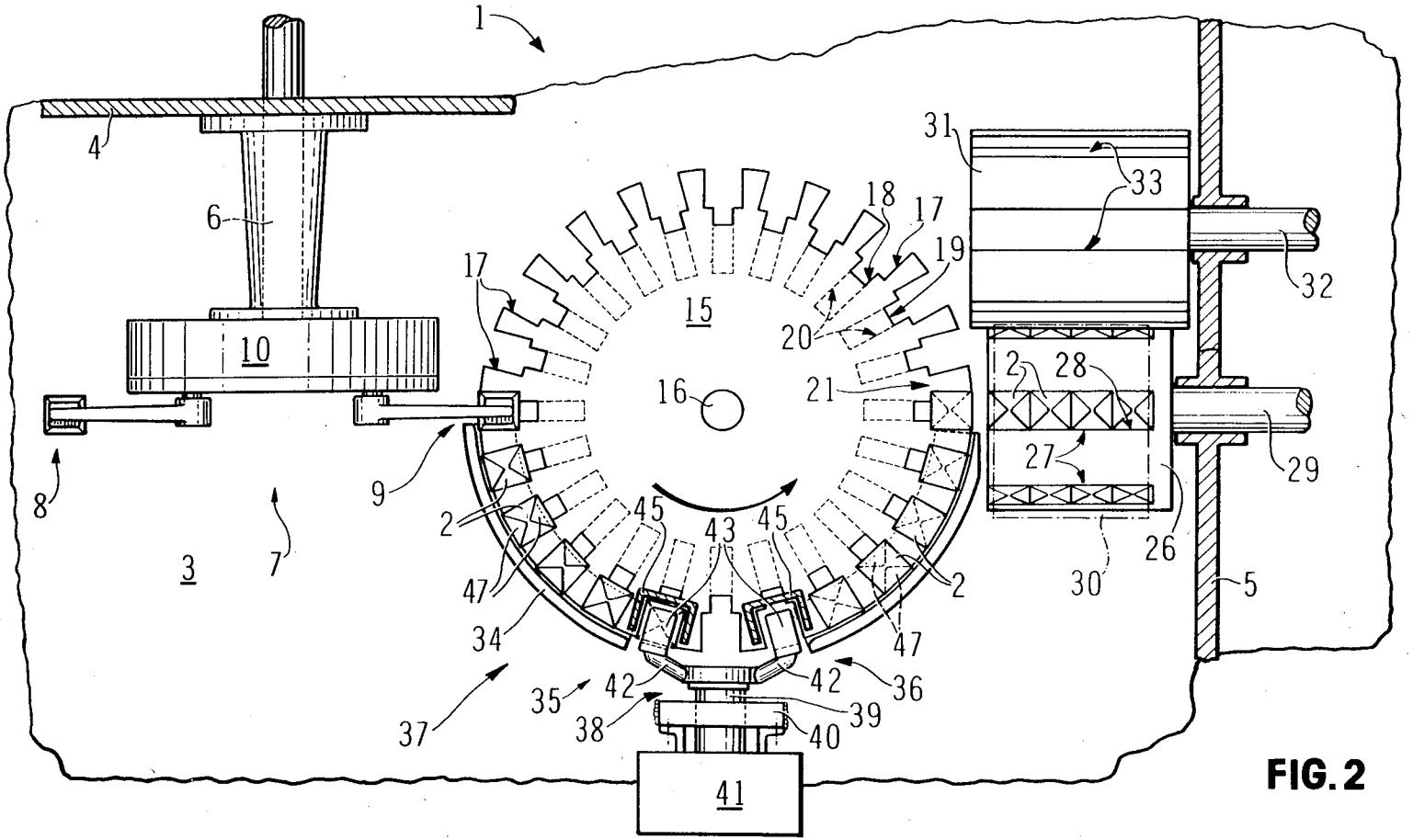
FIG. 2 is a diagrammatic plan view of the machine of FIG. 1, with certain parts shown in section or removed for greater clarity.

In FIGS. 1 and 2, the reference numeral 1 indicates overall a wrapping machine for wrapping in succession individual products 2 of substantially flat parallelepiped form, and for grouping them by arranging them side-by-side edgewise with their contacting edges in a plane normal to the longitudinal dimension of the groups, in order to effect the subsequent overwrapping of the groups obtained.

The machine 1 comprises a baseplate 3 from which there rise two mutually perpendicular, vertical walls 4 and 5.

The wall 4 rotatably supports a shaft 6 normal to it, on which there is keyed a wheel for wrapping individual products 2, which is indicated overall by 7.

This wheel is driven with intermittent rotary motion in a clockwise direction by drive means, not shown, and is arranged to receive in succession the products 2, in a position corresponding with an inlet station 8, from a feed apparatus, not shown, and to wrap them in the so-called "pointed end" manner, to then transfer them to an outlet station 9 diametrically opposite the station 8.

Said wheel 7 comprises a disc 10, keyed on the the shaft 6 and supporting six angularly equidistant grippers 11. Each gripper 11 is composed of two arms 12 mounted at one end on pivots 13 and provided at their other end with gripping elements 14 of resilient material for the products 2. Actuator means of known type, not shown, effect the opening and closure of each gripper 11 at predetermined instants and for predetermined time durations.

In the course of the rotation of the wheel 7, the path followed by said gripping elements 14 and by the products 2 supported by these latter intersects, in a position corresponding with the outlet station 9, a peripheral portion of a disc or conveyor 15 in the form of compartments which is keyed on to a vertical shaft 16 supported rotatably by the baseplate 3.

Drive means, not shown, drive said shaft 15 with intermittent rotary motion in the anticlockwise direction when observing FIG. 2, in determined phase relationship with the intermittent rotation of the wheel 7. The peripheral edge of the disc 15 comprises a plurality of angularly equidistant compartments 17 each arranged to receive a product 2 disposed horizontally flatwise. The radially inner edge of each compartment 17 comprises a recess 18 which is bounded in the direction of the shaft 16 by a face 19, the lower portion of which comprises a bevel 20.

An expulsion element 22, constituted by a lever 23 pivoted at one end on a shaft 24 and supporting at its other end a bar 25 substantially normal to it, operates at a station 21 for discharging the products 2 from the disc 15, this station being diametrically opposite the station 9. The shaft 24 is driven with oscillating rotary motion by drive means, not shown, and causes the bar 25, at each stoppage of the disc 15, to pass through the passage defined by one bevel 20 and one recess 19 with a movement substantially radial to said disc 15, in order to expel a product 2 from the respective compartment 17.

A wheel 26 for transferring and forming groups 27 of products 2, and provided peripherally with six angularly equidistant axial cells 28 and further keyed on to a shaft 29 rotatably supported by the wall 5, maintains one end of one of its cells 28 in a position corresponding with the stations 21 during the extraction of the products 2 from the compartments 17, so as to receive in succession the products 2 arriving from said compartments 17.

Drive means, not shown, drive the shaft 29 with intermittent rotary motion in a determined phase relationship with the rotation of the dis 15, in such a manner as to keep the wheel 26 halted, with cell 28 at rest in a position corresponding with said discharge station 21, for the time necessary for the disc 15 to pass through a number of rotation steps equal to the number of constituent products 2 of one stick. Consequently, during each halt stage if the wheel 26, in one cell 28 of this latter there is formed a group 27 consisting of a number of products 2 equal to the number contained in one stick, and disposed side-by-side such that one minor face of one is in contact with one minor face of the next.

The wheel 26 is partly surrounded by a fixed casing 30 shown by dashed and dotted lines, which extends from said station 21 to a zone in which said wheel 26 is substantially tangential to a wrapping wheel 31 for the groups 27. The purpose of said casing 30 is to retain the groups 27 in the cells 28 during their formation and during their transfer by the wheel 26. Said wheel 31 is disposed parallel to the wheel 26, and is supported and driven with intermittent rotary motion of determined phase relationship to the wheel 26, by a shaft 32 rotatably supported by the wall 5 and connected to drive means, not shown.

Said wheel 31 is provided peripherally with six angularly equidistant radial cells 33 arranged to receive the groups 27 arriving from the wheel 26 under the action of transfer means, not shown. The groups 27 are overwrapped in said cells 33 in known manner by means of wrapping sheets (not shown) fed in a manner not shown.

A fixed casing 34 lowerly and laterally skirts the periphery of the disc 15 between said stations 9 and 21, in order to retain the products 2 in the compartments 17 during the rotation of said disc 15.

At a position defined as the overturning position, which is indicated by 35 and is disposed along the path followed by the products 2 contained in the compartments 17, the casing 34 comprises an interruption, at which there operates an overturning device for the products 2 indicated overall by 36. This latter and the disc 15 constitute a conveying and overturning apparatus for the products 2, indicated by 37.

The device 36 comprises a transfer means 38 rigid with a shaft 39 parallel to the shaft 6 and supported rotatably by a bracket 40 fixed to the baseplate 3.

The bracket 40 also supports an actuator element 41 which is connected to the shaft 39 and is able to cause this to make a clockwise rotation of 180° during each halt stage of the disc 15.

The transfer means 38 is constituted by two bars 42 which are substantially radial to the shaft 39 in a mutually diametrically opposing manner, to support at their free ends two respective gripping elements 43 of substantially U configuration. These latter each extend their two prongs 44 towards the shaft 16 during the halt stages of the overturning device 36 and disc 15, so that they upperly and lowerly embrace two non-consecutive compartments 17 with said prongs.

At the overturning station 35, the disc 15 is upperly covered by a fixed arcuate guide means 45 supported by said bracket 40 in a manner not shown, to define a substantially semicircular channel 46.

Figure 3:
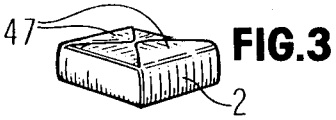
FIG. 3 shows an individual product wrapped in the so-called "pointed end" wrapping manner.

Said channel 46 has a cross-section substantially equal to that of the compartments 17, is open on the opposite side to the shaft 16, and connects together the two compartments 17 associated with the gripping elements 43. When in operation, the wheel 7 wraps the individual products 2 in accordance with the "pointed end" method (see FIG. 3) in known manner, not shown, during the stepwise transfer thereof between the stations 8 and 9. When a product 2 enters a compartment 17 of the disc 15, the gripper 11 which has conveyed it opens, and the disc 15 begins to undergo a rotational step.

As can be seen in FIG. 2, the products 2, on enterring the compartments 17, are disposed with their pointed ends 47 facing upwards.

At each stoppage of the disc 15, the actuator element 41 causes the transfer means 38 to rotate through 180°. During the course of each rotation of this latter, a product 2 travels through the channel 46 until it reaches a compartment 17 disposed downstream of that from which it originates, and becomes arranged in said compartment 17 with its pointed ends 47 facing downwards (see FIG. 2).

At the outlet station 21, the expulsion element 22 extracts in succession the products 2 from the compartments 17 during the halt stages of the disc 15, to then insert them into the cells 28 of the wheel 26 in the already described manner. The groups 27 of products 2 which become formed in said cells 28 have their pointed ends 47 facing the outside of said cells, and can therefore be transferred to the wheel 31 with the pointed ends 47 facing the bottom of its cells 33, in order to be overwrapped.

It should be noted that in the machine according to the present invention, the outer wrapping for the sticks is closed longitudinally on to the opposite face of the products 2 to that against which the pointed ends 47 are folded, thus obviating the drawbacks described in the introduction.

What we claim is:

1. An improved machine for wrapping and grouping products comprising:

a first wrapping wheel for wrapping individual products;

a second wheel for forming and transferring groups constituted by products arranged side-by-side edgewise with their contacting edges in a plane normal to the longitudinal dimensions of said groups, said second wheel being disposed downstream of said first wheel in the direction of advancement of said products;

a third wrapping wheel for wrapping said groups;

a conveying and overturning apparatus for said products disposed between said first wheel and said second wheel, said apparatus having a conveyor constituted by a disk with radially opened compartments for receiving said products in a respective compartment, said first wheel, said disk and said second wheel and third wheel rotating with intermittent motion; and means disposed along the path of said conveyor for transferring each of said products from a first compartment to a second compartment and for overturning it during the course of said transfer, said means for transferring said product comprising two gripping elements which are radially aligned with the positions occupied by two different compartments of said disk during the course of each halt stage thereof, and means for driving said gripping elements with intermittent rotary motion through arcs of 180° about an axis radial to said disk.

2. A machine as claimed in claim 1, wherein said conveying and overturning apparatus comprises arcuate guide means extending between said first and said second compartment.

3. A machine as claimed in claim 2, wherein said gripping elements are substantially of U configuration, their respective prongs being directed towards the axis of said disc and being disposed, in the case of each gripping element during the halt stages of said transfer means, respectively adjacent to the peripheral edges of the two base surfaces of said disc.

4. A machine as claimed in claim 3, wherein during each halt stage of said disc, said gripping elements are radially aligned with the positions occupied by two different non-consecutive compartments of said disc.

* * * * *